US005314379A

United States Patent [19]

Neubauer et al.

[11] Patent Number: 5,314,379

[45] Date of Patent: * May 24, 1994

[54] MAILER FORM AND A COMPOUND FOR PROTECTING AN IMAGE TRANSFER MEDIUM

[75] Inventors: Frank Neubauer, Mount Kisco, N.Y.; Gordon Pickett, Reynoldsburg; Barbara A. Metz, Baltimore, both of Ohio

[73] Assignee: Transkrit Corporation, Brewster, N.Y.

[ * ] Notice: The portion of the term of this patent subsequent to Apr. 20, 2010 has been disclaimed.

[21] Appl. No.: 992,581

[22] Filed: Dec. 18, 1992

[51] Int. Cl.[5] ..... B41L 1/20

[52] U.S. Cl. ..... 462/6; 462/18; 462/39; 283/116

[58] Field of Search ..... 462/6, 26, 28, 36, 39, 462/18; 283/116; 229/72

[56] References Cited

U.S. PATENT DOCUMENTS

| | | | |
|---|---|---|---|
| 4,435,001 | 3/1984 | Mills et al. | 283/116 X |
| 5,153,168 | 10/1992 | Uhlemayr et al. | 462/18 X |
| 5,154,668 | 10/1992 | Schubert | 462/18 X |
| 5,203,739 | 4/1993 | Neubauer | 462/39 X |

*Primary Examiner*—Mark Rosenbaum
*Assistant Examiner*—Willmon Fridie, Jr.
*Attorney, Agent, or Firm*—Francis C. Hand

[57] ABSTRACT

The overcoat emulsion for protection a carbon spot or other image transfer medium against smudging is made from a polyethylene wax emulsion. In addition, a stilt such as wheat starch may be added to the emulsion to improve the pressure absorbing qualities of the overcoat. In addition, a surfactant may be added to the emulsion to improve the wettability characteristics of the emulsion when being applied to a substrate such as a paper ply of a mailer.

11 Claims, 1 Drawing Sheet

Fig. 1.
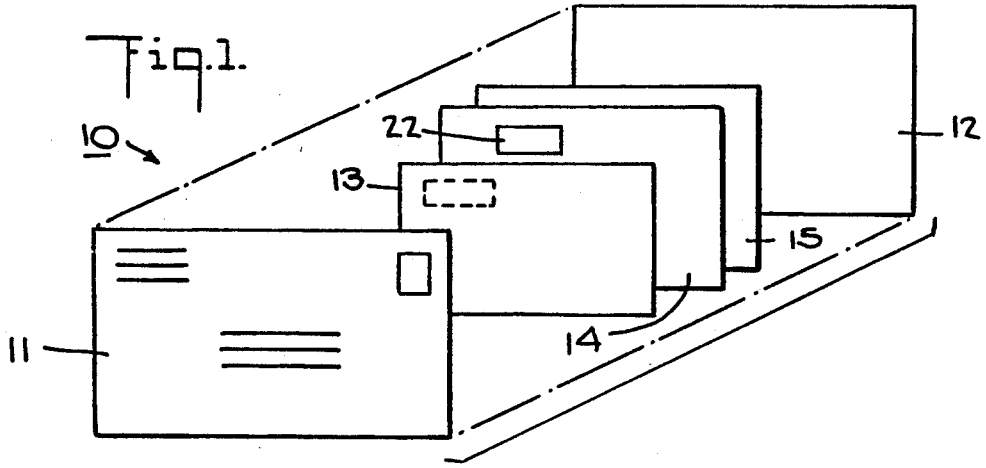
Fig. 2.
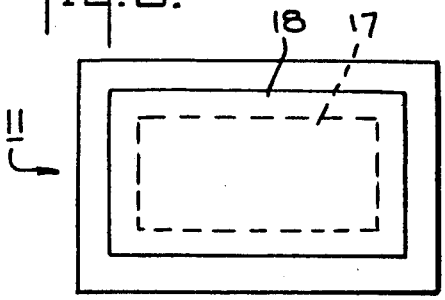
Fig. 3
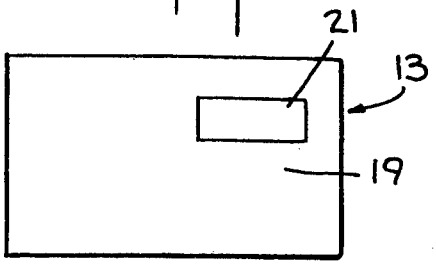
Fig. 4.
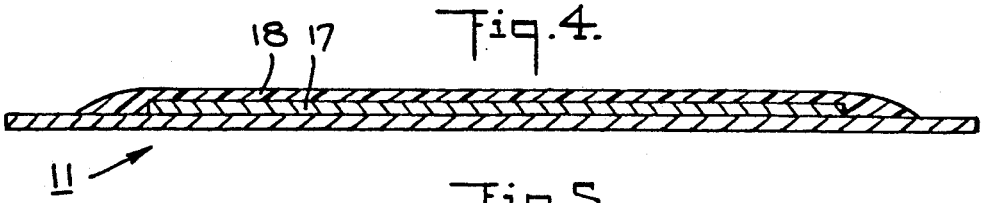
Fig. 5.
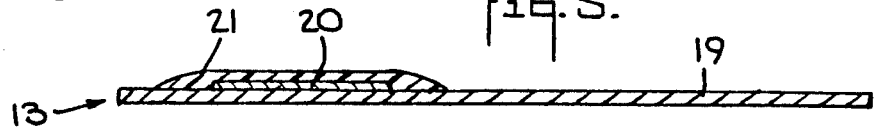
Fig. 6.
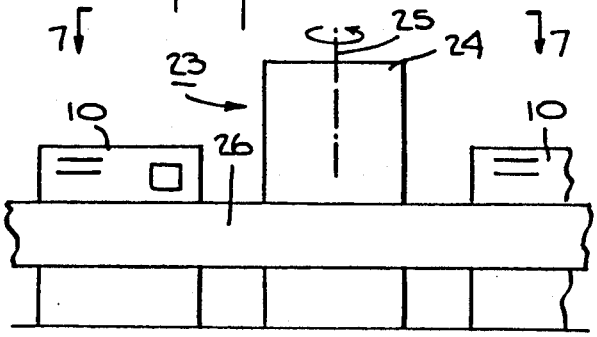
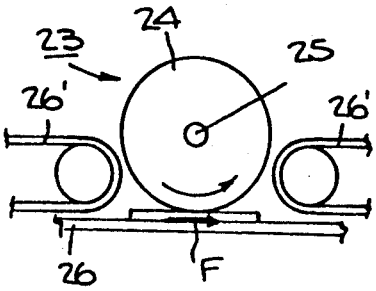
Fig. 7.

MAILER FORM AND A COMPOUND FOR PROTECTING AN IMAGE TRANSFER MEDIUM

This invention relates to a mailer form and a compound for protecting an image transfer medium.

As is known, various types of prestuffed mailer forms have been made which employ a front ply, a back ply secured to the front ply to form an envelope and one or more inserts within the envelope. In addition, it has been known to provide the rear surface of the front ply with a carbon spot or other image transfer medium so that an image imposed on the front ply by an impact printer or other stylus can be transferred onto the insert ply. A number of variations of such a mailer construction are also known, for example wherein the insert ply is provided with a carbon spot or image transfer medium on a rear surface so as to transfer an image onto the face of a return envelope ply under the impact of a stylus.

It has also been known that when such mailer forms are processed in high speed devices such as sorters and cancelers as are now available to the postal authorities, the inserts have become smudged due to the friction from the transfer belts of such devices on the surfaces of the mailer forms. That is, such devices have relied upon belts to transfer a series of mailer forms or envelopes past a drum so that the forms and envelopes can be sorted at a downstream point or cancelled. In some cases, the forms and envelopes are simply run in a rectilinear path past the drum while in other cases, the transfer belts have been wrapped in part about the drums. In either case, it has been found that the transfer belts severely smudge the carbon spots or other image transfer medium within the mailer form to such an extent that the inserts becomes very dirty and sometimes illegible.

U.S. patent application Ser. No. 07/855,265, filed Mar. 23, 1992 describes a mailer form in which an overcoat is placed over an image transfer medium on a rear face of a front ply of a mailer form in order to reduce transfer of an image which is imposed on the front ply under a transversely applied force while, at the same time, being able to transfer an image imposed on the front ply under an impact force. The overcoat is such so as to prevent smudging from occurring on the insert ply. In addition, specific types of materials are also described for use in the overcoat.

It is an object of this invention to improve the qualities of an overcoat applied over an image transfer medium of a mailer form.

It is another object of the invention to provide a compound which can be readily handled and applied over an image transfer medium on a ply of a mailer form.

It is another object of the invention to provide a relatively simple technique to greatly reduce or prevent smudging of an insert within a mailer form by a carbon transfer spot without affecting the purpose intended for the carbon transfer spot.

Briefly, the invention provides a compound for forming an overcoat on an image transfer medium on a ply of paper for a mailer or any other suitable substrate. In this respect, the compound includes a wax emulsion having a solids content of greater than 25% and a stilt in an amount which is sufficient to further act as a barrier to smudging.

In addition, the compound may include a surfactant in an amount sufficient to increase the wettability of the emulsion over an image transfer medium on a paper ply.

One particular compound which has been particularly satisfactory for forming an overcoat includes a polyethylene wax emulsion sold under the designation Michem Emulsion 74040 by Michelman, Inc., Cincinnati, Ohio; a stilt in the form of a Wheat Starch sold by Manildra Milling Corporation under the designation Formula M-80 in an amount of 5% by weight of the emulsion, and a surfactant sold under the designation FC-170C Flurorad Brand Fluorochemical Surfactant by 3-M Industrial Chemical Products Division.

The invention is also directed to a mailer form comprising at least a front ply having a front face for impacting of an imaging means thereon, a back ply secured to the front ply to define a pocket therewith, at least one insert ply disposed in the pocket between the front and back plies, an image transfer medium on a rear face of the front ply for transferring an image imposed on the front ply under an impact force of an imaging means onto the insert ply, and a wax overcoat over at least a part of the transfer medium on the rear of the front ply. The wax overcoat is made from a compound as described above and serves to preclude or greatly reduce transfer of an image imposed on the front ply under a transversely applied force onto the insert ply (i.e. smudges) while allowing transfer of an image imposed on the front ply under an impact force onto the insert ply. That is, the overcoat allows an image to be transferred onto the insert ply by means of an impact force such as generated by an impact printer or other stylus while, at the same time, precluding a force which is applied transversely of the front ply, for example by a relative sliding motion of a transfer belt of a postal sorter across the face of the front ply (or back ply) from transferring an image.

Said another way, the overcoat disposed over the transfer medium precludes or greatly reduces unwanted stray release of the image transfer medium under a transversely applied shear force on the front ply (or back ply) while permitting release of the image transfer medium under an impact force onto the insert ply.

The compound containing the emulsion with or without the stilt and with or without the surfactant may be applied directly over an image transfer medium on a paper ply or other suitable substrate in any suitable means such as by a flexographic printing process. In this respect, the emulsion may be water based so that upon drying, the residue is the wax.

Basically, the purpose of the emulsion is to provide a formulation which has a relatively high solids content and, for example, higher than 25% solids. Where a stilt is used, this would be added so as to enhance the ability of the applied overcoat to absorb pressure. Where a surfactant is used, such would be in an amount sufficient to increase the wettability of the emulsion relative to the paper ply.

These and other objects and advantages of the invention will become more apparent from the following detailed description taken in conjunction with the accompanying drawings wherein:

FIG. 1 illustrates an exploded view of a mailer form constructed in accordance with the invention;

FIG. 2 illustrates a view of the rear face of the front ply of FIG. 1 provided with a carbon spot image transfer medium and an overcoat in accordance with the invention;

FIG. 3 illustrates a view of a rear face of the insert ply of FIG. 1 in accordance with the invention;

FIG. 4 illustrates a cross sectional view of the front ply of FIGS. 1 and 2;

FIG. 5 illustrates a cross sectional view of the insert ply of FIGS. 1 and 3;

FIG. 6 illustrates a schematic view of a postal sorter during operation; and

FIG. 7 illustrates a plan view of the sorter of FIG. 6.

Referring to FIG. 1, the mailer form 10 is of generally conventional structure and is comprised of a front ply 11, a back ply 12, at least one insert ply 13 and a return envelope formed of two plies 14, 15 which are secured together in any known manner. The mailer 10 is of a conventional structure and may be supplied to a user in the form of a continuous mailer assembly as is well known. As indicated, the front ply 11 is of rectangular shape and has a front face for impacting of an imaging means such as an impact printer or stylus thereon. As schematically indicated, addressor and addressee information can be imaged on the front face of the front ply 11.

The back ply 12 is secured to the front ply 11, for example by lines of glue (not shown) or other suitable securing means in order to define a pocket therewith. As indicated, the back ply 12 is of rectangular shape.

The insert ply 13 is also of a rectangular shape and is disposed in the pocket between the front and back plies 11, 12. The insert ply 13 may be held in place by fugitive glue spots or in any other suitable fashion.

The return envelope plies 14, 15 are of rectangular shape and are suitably structured to function as a return mail envelope.

Referring to FIG. 2, the front ply 11 is provided with an image transfer medium 17 on the rear face. The image transfer medium 17 may be in the form of a layer of hot wax spot carbon, for example, having a thickness of from 2 to 10 microns and may be formed in a rectangular block shape to cover a substantial portion of the rear face of the front ply 11. Alternatively, the transfer medium may be disposed in separate spaced apart blocks on the rear face of the front ply 11. Still further, the transfer medium 17 may be formed of a layer containing microcapsules of an image transfer material as is well known in the art.

Referring to FIGS. 2 and 4, an overcoat 18 is provided over at least a part of the transfer medium 17. In the example illustrated, the overcoat 18 extends beyond the image transfer medium 17 and adheres directly to the rear surface of the front ply 11. This overcoat 18 is characterized as being able to preclude transfer of an image imposed on the front ply 11 under a transversely applied force, that is, a shear or friction force, onto the insert ply 13 while transferring an image imposed on the front ply under an impact force, such as imposed by an impact stylus onto the insert ply 13. The overcoat 18 may be applied over the entire area of the transfer medium 17 or only over a portion of the transfer medium 17. This may depend upon the areas of the front ply 11 which would be most likely to be subjected to a transversely applied force, i.e. a shear force. In the preferred embodiment, the overcoat 18 overlaps or exceeds the boundary of the transfer medium 17.

Referring to FIGS. 3 and 5, the rear faces 19 of the insert ply 13 may also be provided with an image transfer medium 20 (FIG. 5) in a localized area as well as with an overcoat 21 over the image transfer medium 20. The transfer medium 20 on the insert ply 13 can be used to transfer an image onto a block 22 on the front face of the first ply 14 of the return envelope as indicated in FIG. 1. However, the overcoat 21 serves, as above, to preclude transfer of an image imposed on the front ply 11 under a transversely applied shear force onto the front face of the return envelope 14, 15 while being able to transfer an image imposed on the front ply 11 under an impact force onto the front face of the ply 14 of the return envelope via the image transfer medium 20.

Referring to FIGS. 6 and 7, the mailer form 10 can be automatically processed in a postal sorter 23 as is known which operates at a high speed. For example, the sorter 23 includes a sorter drum 24 which is rotatably about a fixed axis 25 for reading the imaging on the face of a mailer form 10 for sorting purposes downstream of the drum 24. As indicated, transfer belt 26 are provided to transfer the mailer at a high speed to a position between a transfer belt 26 and the drum 24.

As schematically indicated in FIG. 7, an endless belt 26' cooperates with the transfer belt 26 to convey a series of mailers 10 sequentially to the rotating drum 24 while a second endless belt 26' cooperates with the main transfer belt 26 to convey the mailers 10 beyond the drum 24.

During transfer of the mailer forms between the belts 26, 26' and between the belt 26 and drum 24, slippage may take place between the belts 26, 26' or between the belt 26 and drum 24. As a result, a transversely applied force, i.e. a friction or shear force F is imposed on the mailer form 10 (see FIG. 7). Without the overcoat 18 on the rear face of the front ply 11, the transversely applied force F would cause a stray release of the image transfer medium, i.e. carbon, and thus form a smudged image on the face of the insert ply 13. Likewise, where the insert ply 13 may have an image transfer medium 20 on the rear face 19 (see FIGS. 3 and 5), a smudged image may be formed on the front face of the ply 14 of the return envelope under the transfer medium 20.

However, the overcoat 18 on the front ply 11 and the overcoat 21 on the rear face of the insert ply 13 preclude or reduce any stray release of the image transfer mediums from the respective plies 11, 13.

The overcoat 18 which is applied on the front ply 11 allows an impact force on the face of the front ply 11 to create an image on the insert ply 13 by releasing the image transfer medium 17 through the overcoat 18 onto the insert ply 13. Likewise, an impact force over the transfer medium 20 of the insert ply 13 will effect formation of an image within the block 22 of the front face of the back ply 14.

The overcoat 18 which is applied on the rear face of the front ply 11 over the transfer medium 17 may have a thickness of from 2 to 10 microns.

In order to apply the overcoat 18, a compound is first obtained which is comprised of a wax emulsion, such as a polyethyelene wax emulsion, having a solids content of greater than 25% and the emulsion applied directly over the transfer medium 17. To this end, the emulsion may be a polyethylene wax emulsion sold under the designation Michem® Emulsion 74040 by Michelman, Inc., Cincinnati, Ohio. This emulsion contains a solids content of from 39.5% to 40.5% by weight and has an average particle size of 35 nanometers (nm).

In order to improve the pressure absorbing characteristics of the resultant overcoat, a stilt in the form of a wheat starch, sold under the designation M-80 by Manildra Milling Corporation, Minneapolis, Minn. is added to the emulsion. Such a wheat starch is a granular product with a controlled uniform narrow particular size distribution which is designed for use in the production of carbonless copy paper or any application where the deposition of an inert granular material is desired. This stilt may be added in an amount of from 0.5 to 20% by weight of the emulsion, and preferably 5% by weight of the emulsion.

Further, to enhance wettability, a surfactant may be added to the emulsion in an amount sufficient to increase the wettability of the emulsion over the transfer medium 17. For example, the surfactant may be in an amount of from 0.1 to 10% by weight of the emulsion and preferably 1% by weight of the emulsion. A suitable surfactant has been found to be one sold under the designation FC-170C Flruoad Brand Fluorochemical Surfactant by 3-M Industrial Chemical Products Division, St. Paul, Minn.

The emulsion or compound employing the emulsion can be readily used in forming an overcoat over the transfer medium 17. In this respect, various techniques may be used for applying the compound, for example, such as by a flexographic printing process.

Use of an overcoat made in accordance with the above described polyethylene wax emulsion has been found to be particularly resistant to smudging. Further, the emulsion or compound employing the emulsion has been found to be relatively easy to use in forming an overcoat.

The wax which is applied as the overcoat may be applied in any suitable manner. For example, the wax may be applied, as described above, in an emulsified form which, upon drying, will leave a wax residue or as any oil/wax compound. The wax may also be directly applied.

In addition to the polyethylene wax which is described above, the wax which is used for the overcoat may be selected from the group consisting of Silicone Wax, Montan, Candellila, Paraffin, Bee's Wax and Microcrystalline Wax.

The carbon transfer medium may have a thickness in the range of from 2 to 15 microns with a preferred range of from 2 to 10 microns and specifically from 5 to 6 microns. In this regard, the overcoat would have a thickness in a range of from 2 to 15 microns with a preferred range of 6 to 8 microns.

As described above, the stilt which is used is a wheat starch. In addition, other stilts may be used such as a stilt (approximately 5–50$\mu$ in diameter) from the group consisting of arrowroot, tapioca, corn, potato and rice.

The surfactant which is used may be any suitable type of the thousands which are known. Generically, the surfactants may be identified by the families consisting of ethoxylated, ethoxylated nonyl, ethoxylated linear alcohols and phenols. Specific surfactants which may be used include but are not limited to, Igepal TM CO-630 sold by GAF, Poly-Tergent B-300, sold by Olin Chemical Co., Tergitol 15-S7 sold by Union Carbide and Triton X-100 sold by Rhomn & Haas.

The various examples of waxes, stilts and surfactants which are provided above are not intended to be all-inclusive but exemplify the types of materials which can be used within the scope of the invention.

What is claimed is:

1. A mailer form comprising a front ply having a front face for impacting of an imaging means thereon and a rear face;

a back ply secured to said front ply to define a pocket therewith;

at least one insert ply disposed in said pocket between said front ply and said back ply;

an image transfer medium on said rear face of said front ply for transferring an image imposed on said front ply under an impact force of an imaging means onto said insert ply; and a polyethylene wax overcoat over at least a part of said transfer medium to reduce transfer of an image imposed on said front ply under a transversely applied force onto said insert ply while transferring an image imposed on said front ply under an impact force onto said insert ply.

2. A mailer form as set forth in claim 1 wherein said overcoat has a thickness of from 2 to 10 microns.

3. A mailer form as set forth in claim 1 wherein said overcoat includes a surfactant.

4. A mailer as set forth in claim 3 wherein said overcoat includes a stilt.

5. A mailer form as set forth in claim 4 wherein said stilt is a starch.

6. A mailer form as set forth in claim 1 wherein said overcoat includes a stilt.

7. A mailer form as set forth in claim 6 wherein said stilt is a starch.

8. A mailer form as set forth in claim 1 wherein said transfer medium is a layer of carbon having a thickness of from 2 to 10 microns.

9. A mailer form as set forth in claim 1 wherein said transfer medium is a layer containing microcapsules of image transfer material.

10. A mailer form as set forth in claim 1 which further comprises a return envelope between said insert ply and said back ply and wherein said insert ply has a rear face facing said return envelope and which further includes a second image transfer medium on said rear face of said insert ply for transferring an image imposed on said front ply under an impact force onto said return envelope and a second wax overcoat over at least a part of said second image transfer medium to preclude transfer of an image imposed on said front ply under a transversely applied shear force while transferring an image imposed on said front ply under an impact force of an imaging means onto said return envelope.

11. A mailer form comprising a front ply having a front face for impacting of an imaging means thereon and a rear face;

a back ply secured to said front ply to define a pocket therewith;

at least one insert ply disposed in said pocket between said front ply and said back ply;

an image transfer medium on said rear face of said front ply for transferring an image imposed on said front ply under an impact force of an imaging means onto said insert ply; and an overcoat over at least a part of said transfer medium to reduce transfer of an image imposed on said front ply under a transversely applied force onto said insert ply while transferring an image imposed on said front ply under an impact force onto said insert ply, said overcoat containing a polyethylene max, a starch in an amount sufficient to form a stilt and a surfactant.

* * * * *

UNITED STATES PATENT AND TRADEMARK OFFICE

CERTIFICATE OF CORRECTION

PATENT NO. : 5,314,379

DATED : May 24, 1994

INVENTOR(S) : Frank Neubauer, et al

It is certified that error appears in the above-identified patent and that said Letters Patent is hereby corrected as shown below:

Column 6, line 65 "max" should be -wax-

Signed and Sealed this

Sixteenth Day of August, 1994

*Attest:*

*Attesting Officer*

BRUCE LEHMAN

*Commissioner of Patents and Trademarks*